United States Patent [19]

Lee

[11] Patent Number: 4,553,485

[45] Date of Patent: Nov. 19, 1985

[54] EXTENSION TABLE WITH SINGLE LEG

[76] Inventor: Chain-Hsiang Lee, No. 303, Tze-Li 1st Rd., Kaohsiung, Taiwan

[21] Appl. No.: 440,009

[22] Filed: Nov. 8, 1982

[51] Int. Cl.[4] ..... A47B 1/08

[52] U.S. Cl. ..... 108/86; 108/87

[58] Field of Search ..... 108/83, 87, 86, 84, 108/67

[56] References Cited

U.S. PATENT DOCUMENTS

| | | | |
|---|---|---|---|
| 1,302,420 | 4/1919 | Nyholm | 108/87 X |
| 1,358,353 | 11/1920 | Zimmer | 108/67 |
| 1,668,174 | 5/1928 | Snyder | 108/67 |
| 1,766,694 | 6/1930 | Siskin | 108/87 |
| 3,294,042 | 12/1966 | Charne et al. | 108/86 X |

FOREIGN PATENT DOCUMENTS

| | | | |
|---|---|---|---|
| 156430 | 1/1921 | United Kingdom | 108/67 |

*Primary Examiner*—Francis K. Zugel

[57] ABSTRACT

The present invention relates to an improved extension table with single leg, and in particular to one comprising two movable top sections. Two detachable leaves which can be folded up and placed therein, and some accessories, charaterized in that the detachable leaves can be easily placed within the table by means of guidances provided under the movable top sections in association with guide pins and supporting plates of the detachable leaves.

1 Claim, 14 Drawing Figures

EXTENSION TABLE WITH SINGLE LEG

BACKGROUND OF THE INVENTION

Although extension tables have been known for a long time, they have the following drawbacks.

1. Referring to FIG. 8, FIG. 10, and FIG. 14, there are shown three known extension tables each provided with four legs. The steps of operating the tables described above are as follows. First, folding the central rectangular boards; second, placing the central rectangular boards under the top surface of the table; and pushing the top surface boards together. The drawbacks of the table described above are:

(1) Two people are required to extend or contract any one of the above mentioned tables.

(2) When the table is being expanded, the central rectangular boards may fall and hurt the persons sitting near the table.

(3) Since the table has four legs, the space for the persons sitting around the table to put their feet is limited.

2. Referring to FIG. 9, there is shown a known extension table with a single leg. Before the table is contracted, it is necessary to take away the central rectangular board; thus the central rectangular board has to be stored in another place. The drawbacks of the table are:

(1) It is necessary to take away the central rectangular board and store it in another place before the table is contracted, thereby raising a problem of storing the central rectangular board.

(2) It is very inconvenient to extend or contract the table.

It is, therefore, an object of the present invention to provide an improved extension table with single leg.

SUMMARY OF THE INVENTION

The primary object of the present invention is to provide an improved extension table with a single leg comprising two detachable leaves which are easy to be placed under the table by guidances provided under the top surface of the table in association with guide pins and supporting plates of the detachable leaves.

Another object of the present invention is to provide an improved extension table with a single leg having two detachable leaves which can be placed steadily under the top surface thereof.

The advantages of the present invention are as follows:

1. Only one person is required to extend or contract the present improved extension table.

2. By using supporting plates of the detachable leaves, extending or contracting the present extension table is steady and safe.

3. It is convenient to place the detachable leaves under the top surface of the extension table with a single leg according to the present invention.

4. Since a mechanism composed of a gear and two racks is adopted, the operation of extending or contracting the extension table with single leg according to the present invention is very smooth.

DETAILED DESCRIPTION OF THE PREFERRED EMBODIMENT

Figure 5:
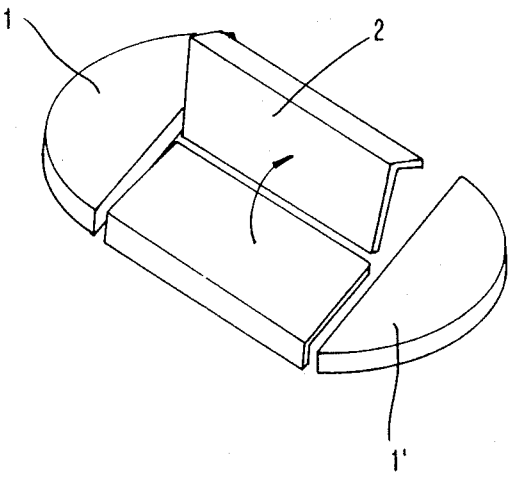
FIG. 5 shows how to fold the detachable leaves of the improved extension table with a single leg according to the present invention.
Figure 1:
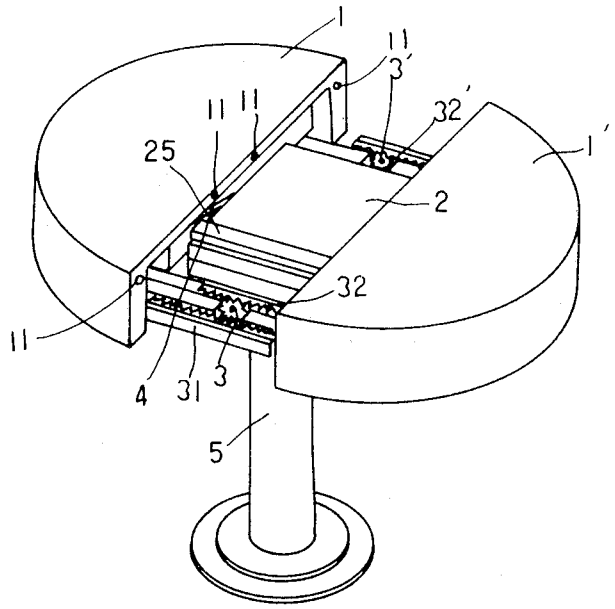
FIG. 1 is a perspective view of an improved extension table with a single leg according to the present invention.
Figure 2:
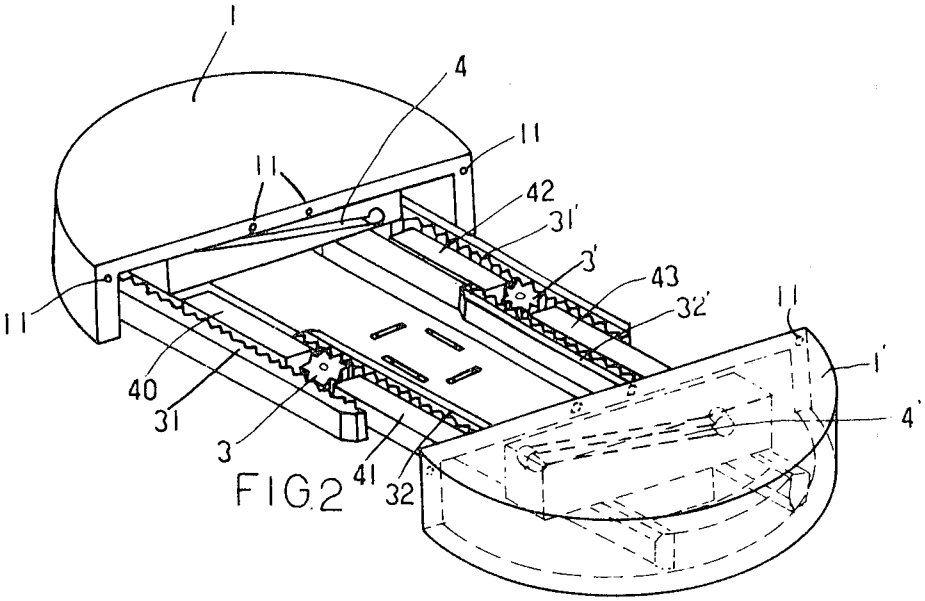
FIG. 2 shows the inner structure of the improved extension table with a single leg according to the present invention.
Figure 3:
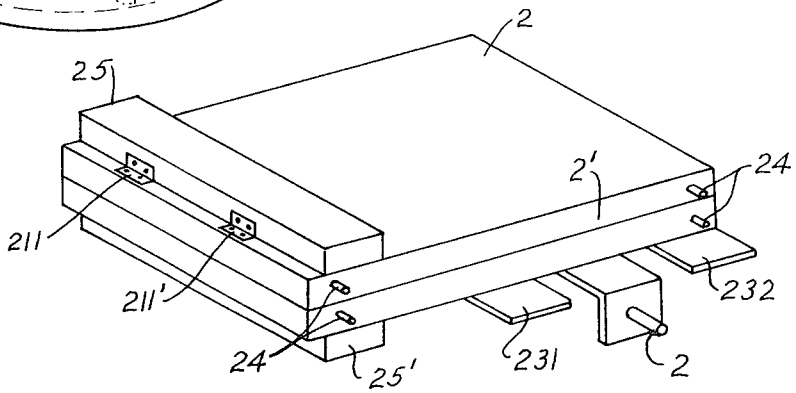
FIG. 3 is a perspective view of the detachable leaves of the improved extension table with a single leg according to the present invention.
Figure 4:
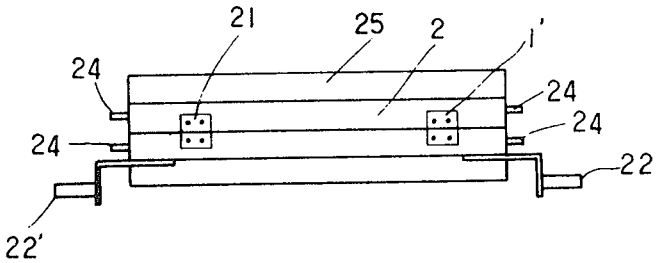
FIG. 4 is a front view of the detachable leaves of the improved extension table with a single leg according to the present invention.
Figure 7:
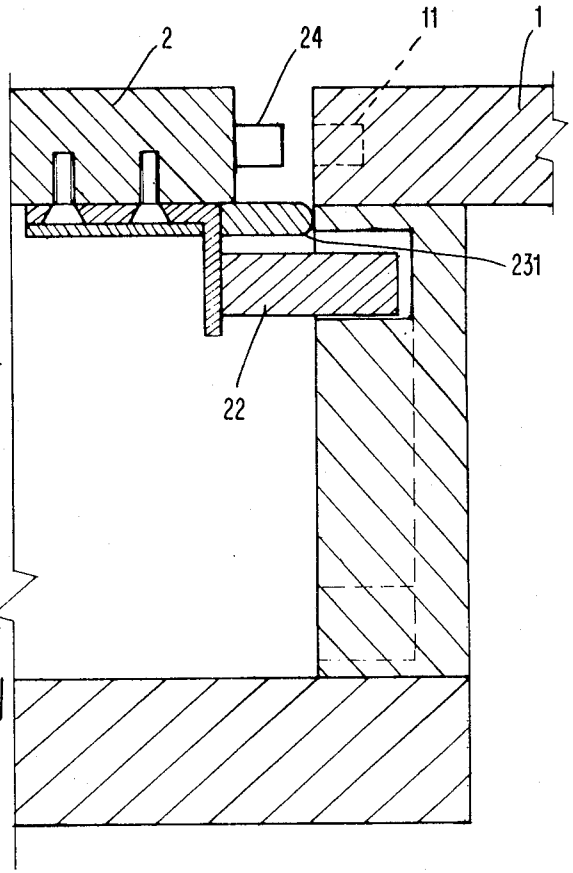
FIG. 7 shows a partial sectional view of the improved extension table with a single leg according to the present invention in an extended position.
Figure 6:
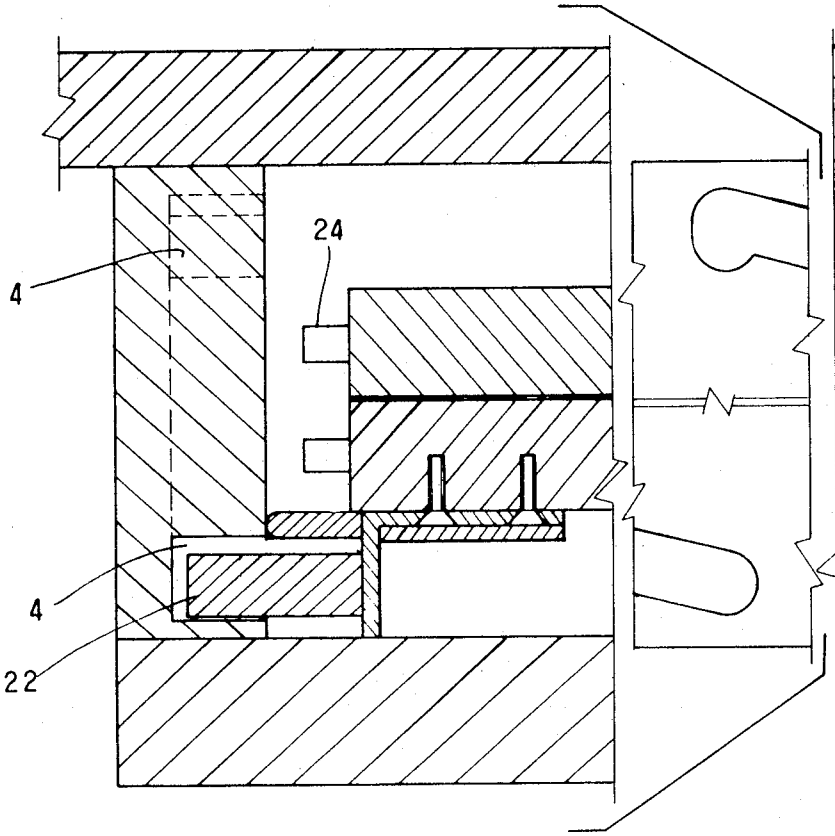
FIG. 6 shows a partial sectional view of the improved extension table with a single leg according to the present invention in a closed position.
Figure 8:
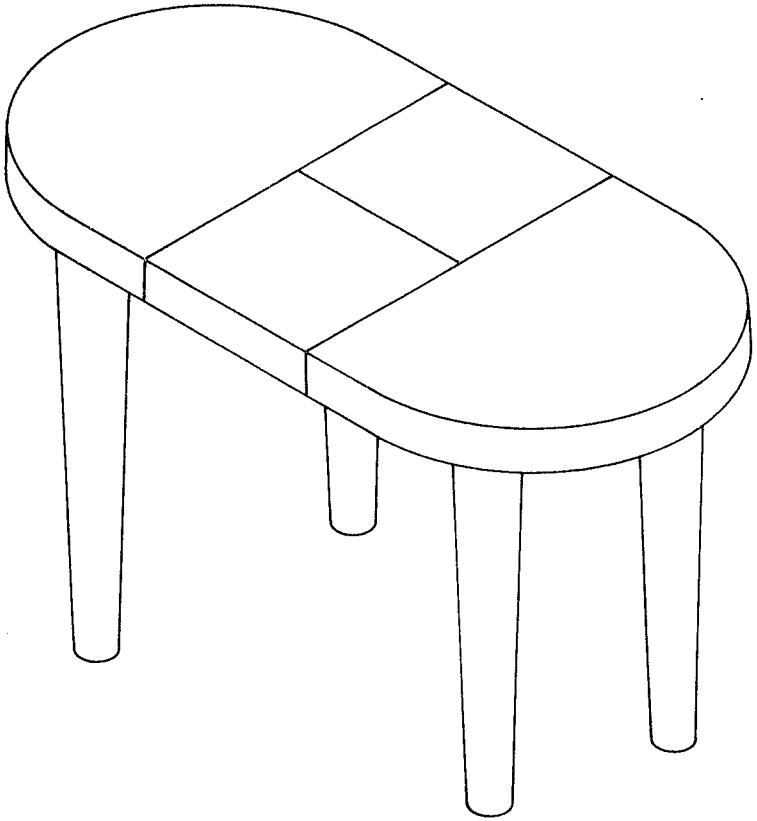
FIG. 8 is a perspective view of a known extension table with four legs.
Figure 9:
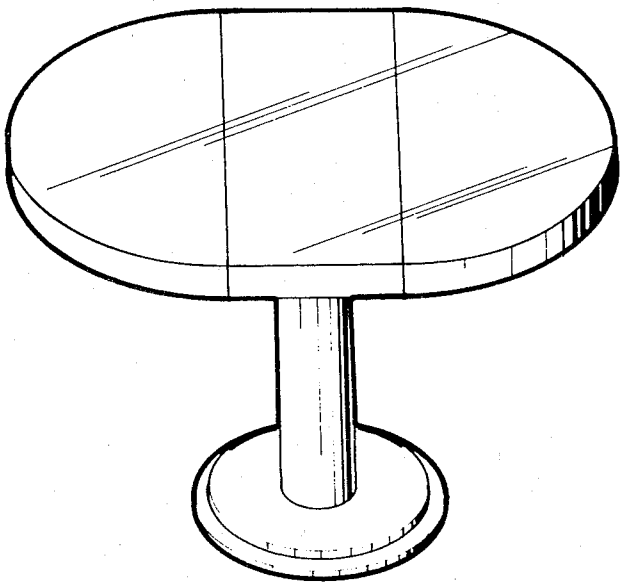
FIG. 9 is a perspective view of another known extension table with a single leg.
Figure 10:
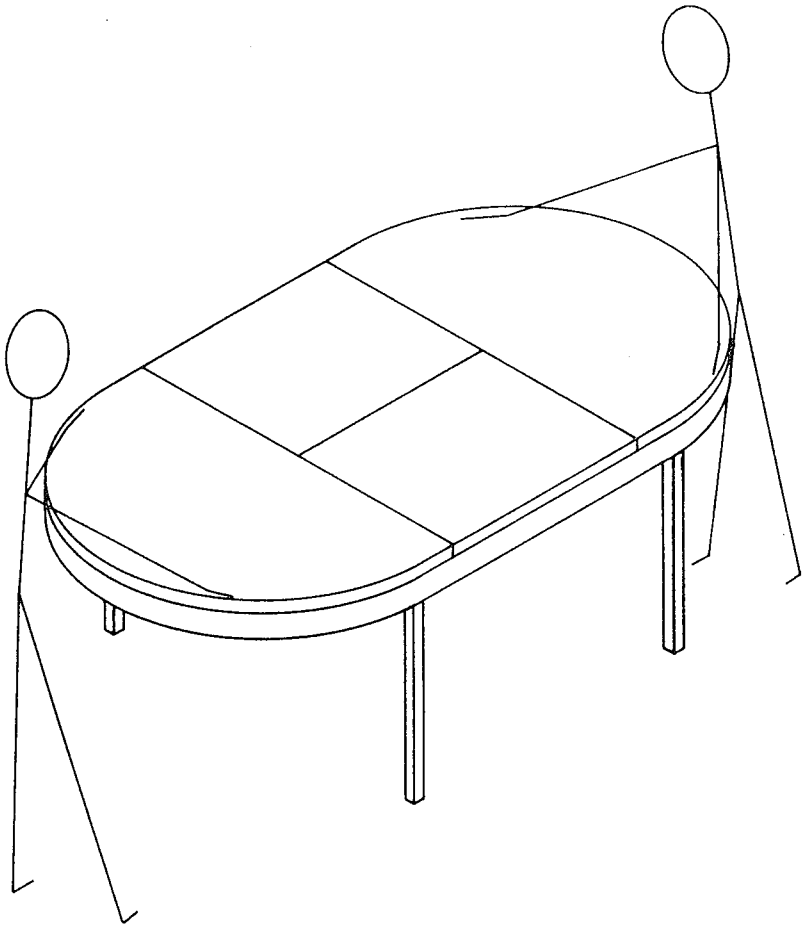
FIG. 10 shows how to operate a known circular extension table with four legs.
Figure 13:
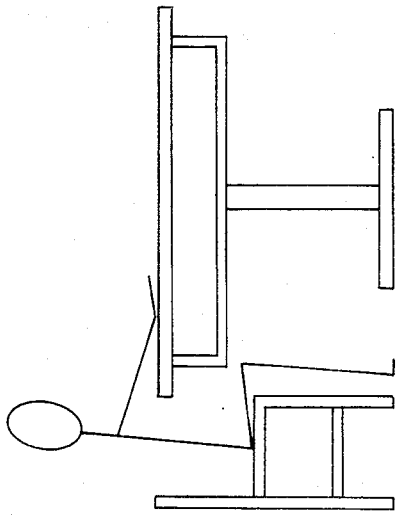
FIG. 13 is a side view of a known extension table with a single leg.
Figure 12:
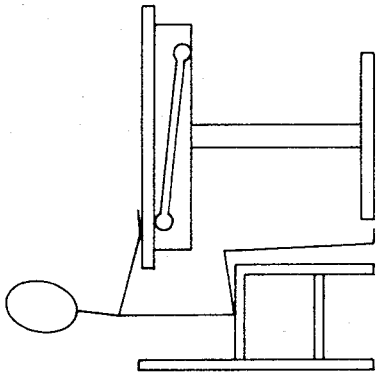
FIG. 12 is a side view of the improved extension table with a single leg according to the present invention.
Figure 11:
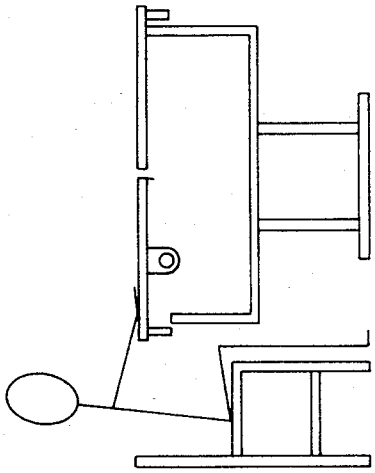
FIG. 11 is a side view of a known extension table with four legs.
Figure 14:
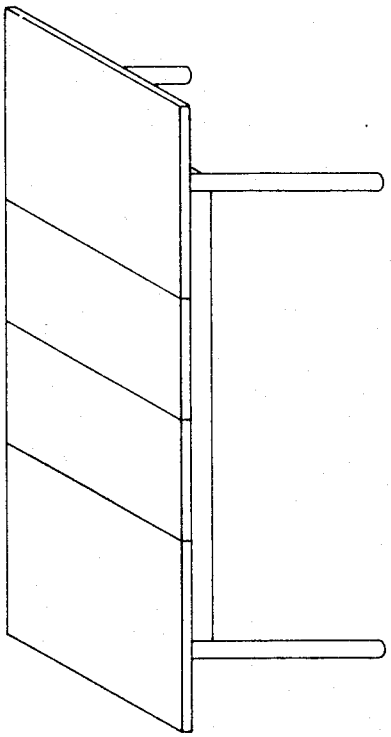
FIG. 14 is a perspective view of a known extension table with four legs.

With reference to FIG. 1, FIG. 2, FIG. 3, FIG. 4, and FIG. 5, the present invention comprises two top sections (1, 1') each having four parts that are often used for matching four holes (11) adapted to match pins (24) of detachable leaves (2, 2'). Two inclined guidances (4, 4') having enlarged ends provided under each of the top sections (1, 1'). When pins (24) of detachable leaves (2, 2') and holes (11) of the top section (1, 1') are engaged, top sections (1, 1') and detachable leaves (2, 2') will lie on the same plane. Detachable leaves (2, 2') are connected by hinges (21, 21'). Wings (25, 25') are connected to detachable leaves (2, 2') by hinges (211, 211'). Both sides of detachable leaves (2, 2') are provided with two guide rods (22, 22') respectively. Guide rods (22, 22') are inserted into guidances (4, 4') when the present extension table is contracted. At the sides of guide rods (22, 22') are mounted supporting plates (231, 232) and (231', 232') respectively. Besides, on the bottom plane are mounted four rods (40, 41, 42, 43) which are used for steadying and supporting the detachable leaves (2, 2'). Supporting plates (231, 232, 231', 232') are used for steadying the detachable leaves (2, 2') at the time the table is being contracted. The steps of contracting detachable leaves (2, 2') are as follows. Pull out top sections (1, 1') by a short distance. Fold up detachable leaves (2, 2'), and at the same time place guide rods (22, 22') of detachable leaves (2, 2') into guidances (4, 4'), and then let detachable leaves (2, 2') slide down guidances (4, 4'). As a result, detachable leaves (2, 2') are located at the central part of the table, and guide rods (22, 22') are located at the larger ends of the guidances (4, 4'). Afterwards, push detachable leaves (2, 2') together. In addition, the present extension table is provided with two gears (3, 3') and four racks (31, 32, 31', 32'). As shown in FIG. 2, gear (3) and racks (31, 32) are mounted to one side of the extension table, gear (3') and racks (31', 32') are mounted to the other side. The gear (3) is disposed between the rods (40) and (41) while the gear (3') is disposed between the rods (42) and (43). Due to the cooperation of gears (3, 3') and racks (31, 32, 31', 32). The subject extension table can be extended or contracted by only pulling out or pushing in any one of top boards (1, 1').

I claim:

1. An extension table with a single leg comprising a leg;

a bottom plane mounted on said leg;

two top sections movably mounted on said bottom plane, each top section having an inclined guidance provided thereunder, each guidance having enlarged ends, and four holes on each side surface facing the center of the table, two rods mounted apart but along a straight line on each side of said bottom plane;

two gears, one disposed between the ends of said two rods;

four rods two of which are mounted to one of said top sections and the other two of which are mounted to the other top section, said racks being engageable with said gears;

two detachable leaves provided on each side with a guide rod for engaging said guidances of said top sections, each said detachable leaf being formed at two opposite sides with four pins insertable into the four holes on each said top section, said detachable leaves being connected together by hinges, each said detachable leave having a wing hinged to the outer side thereof; and two supporting plates for steadying the movement of the leaves being fixed on the bottom of and extending from two sides of the detachable leave which forms the lower one when the two detachable leaves are folded on top of each other.

* * * * *